US012680281B2

(12) United States Patent
Kury et al.

(10) Patent No.: US 12,680,281 B2
(45) Date of Patent: Jul. 14, 2026

(54) USE OF A HOSE FOR THE FLUIDIC CONNECTION OF AN OUTLET PIECE TO A VALVE ON A SANITARY FITTING, FLUIDIC ARRANGEMENT AND CORRESPONDING SANITARY FITTING

(71) Applicant: Neoperl GmbH, Müllheim (DE)

(72) Inventors: Werner Kury, Müllheim (DE); Daniel Oechsle, Müllheim (DE); Holger Schürle, Müllheim (DE); Dietmar Walser, Efringen-Kirchen (DE)

(73) Assignee: Neoperl GmbH, Müllheim (DE)

( * ) Notice: Subject to any disclaimer, the term of this patent is extended or adjusted under 35 U.S.C. 154(b) by 370 days.

(21) Appl. No.: 18/031,676

(22) PCT Filed: Oct. 15, 2021

(86) PCT No.: PCT/EP2021/078599
§ 371 (c)(1),
(2) Date: Apr. 13, 2023

(87) PCT Pub. No.: WO2022/079233
PCT Pub. Date: Apr. 21, 2022

(65) Prior Publication Data

US 2023/0383507 A1 Nov. 30, 2023

(30) Foreign Application Priority Data

Oct. 16, 2020 (DE) ..... 202020105935.1

(51) Int. Cl.
*E03C 1/04* (2006.01)

(52) U.S. Cl.
CPC ..... *E03C 1/0403* (2013.01); *E03C 1/0404* (2013.01)

(58) Field of Classification Search
CPC ..... E03C 1/0403; E03C 1/0404
USPC ..... 4/678
See application file for complete search history.

(56) References Cited

U.S. PATENT DOCUMENTS

| | | | | |
|---|---|---|---|---|
| 5,090,062 | A | 2/1992 | Hochstrasser | |
| 5,329,957 | A * | 7/1994 | Semchuck | E03C 1/0403 137/217 |
| 6,704,946 | B1 | 3/2004 | Mueller et al. | |
| 2008/0178935 | A1* | 7/2008 | Thomas | G05D 11/03 137/119.04 |
| 2011/0061754 | A1 | 3/2011 | Thomas et al. | |
| 2011/0073205 | A1* | 3/2011 | Marty | E03C 1/0403 137/801 |
| 2017/0030056 | A1* | 2/2017 | Prabhakar | F16K 31/524 |
| 2017/0183846 | A1 | 6/2017 | Hansen et al. | |
| 2019/0330828 | A1* | 10/2019 | Yan | E03C 1/025 |

(Continued)

FOREIGN PATENT DOCUMENTS

| | | | |
|---|---|---|---|
| CN | 201021725 | Y | 2/2008 |
| CN | 201343748 | Y | 11/2009 |

(Continued)

*Primary Examiner* — Huyen D Le
(74) *Attorney, Agent, or Firm* — Volpe Koenig

(57) ABSTRACT

In a fluidic arrangement (2) which can be mounted inside a sanitary fitting (1), a hose (5) which connects an outlet piece (3) to a valve (4) is designed such that a length of the hose (5) projects from an interior (6) which spatially connects the valve (4) to the outlet piece (3). This projecting portion of the hose (5) is fluidically connected to the valve (4) outside the interior (6).

24 Claims, 6 Drawing Sheets

(56) References Cited

U.S. PATENT DOCUMENTS

| | | | | |
|---|---|---|---|---|
| 2022/0074177 | A1* | 3/2022 | DeVries | E03C 1/057 |
| 2022/0154434 | A1* | 5/2022 | Reich | E03C 1/0404 |

FOREIGN PATENT DOCUMENTS

| | | | |
|---|---|---|---|
| CN | 210623873 | U | 5/2020 |
| CN | 215858012 | U | 2/2022 |
| DE | 102013020586 | | 6/2015 |
| EP | 0432553 | | 9/1991 |
| EP | 3228768 | | 10/2017 |
| JP | 2015004210 | A | 1/2015 |
| JP | 2015175494 | A | 10/2015 |
| JP | 2018021629 | A | 2/2018 |
| JP | 2019503445 | A | 2/2019 |
| KR | 20050036956 | A | 4/2005 |
| WO | 2009143352 | | 11/2009 |
| WO | 2017123087 | | 7/2017 |

* cited by examiner

USE OF A HOSE FOR THE FLUIDIC CONNECTION OF AN OUTLET PIECE TO A VALVE ON A SANITARY FITTING, FLUIDIC ARRANGEMENT AND CORRESPONDING SANITARY FITTING

CROSS-REFERENCE TO RELATED APPLICATIONS

This application is a 371 national phase of PCT/EP2021/078599, filed Oct. 15, 2021, which claims priority from German Patent Application No. 20 2020 105 935.1, filed Oct. 16, 2020, both of which are incorporated by reference herein as if fully set forth.

TECHNICAL FIELD

The invention relates to the use of a hose for fluidically connecting an outlet piece to a valve on a sanitary fitting, wherein the outlet piece can be fixed to the sanitary fitting.

The invention also relates to a fluidic arrangement for a sanitary fitting, having an outlet piece and a valve and a hose, which fluidically connects the outlet piece to the valve, wherein the hose is connected fluidically at a location of the valve that, in the use position of the valve, is directed away from the outlet piece.

Finally, the invention relates to a sanitary fitting.

BACKGROUND

It is known to utilize hoses in sanitary fittings in accordance with the use described in the introduction. This makes it possible to separate the liquid-channeling function from the mechanical support of the sanitary fitting and therefore to create a greater degree of design freedom on the sanitary fitting.

SUMMARY

The invention is based on the object of simplifying the installation of a sanitary fitting.

This object is achieved using one or more features according to the invention as described herein. In particular, it is therefore proposed according to the invention, in respect of the use of the type described in the introduction, that, between the outlet piece and its valve end, the hose should extend in a portion outside a housing of the sanitary fitting. It is therefore possible to form a change in direction, for example a curved loop or a deflection of the hose, for the return to the valve, outside the confines of the housing.

A further advantage is that a location at which the hose can be connected to the valve can be arranged such that, during the installation, visual monitoring is possible and/or that it is easily possible to compensate for different hose lengths.

It is also advantageous that it is possible for the valve to be installed first, before the hose has to be connected fluidically to the valve. This can simplify the installation of the valve since it is thus possible to avoid the situation where already connected hoses form a resistance against the valve being inserted and thus, for example, cause the valve to tilt. Unwanted kinking of the hose when the valve is being inserted can also be avoided in this way.

The invention therefore brings its advantages to bear particularly in respect of fixedly installed or installable hoses in which the hose end at the outlet piece is not accessible from the outside during use.

Provision can be made for at least part of the hose to be arranged in an interior space of the sanitary fitting, the interior space extending between the outlet piece and the valve. It is therefore possible for the hose to be arranged, for example, in an outlet tube.

Provision can be made here for the hose to be routed out of the interior space and to be connected to the valve outside the interior space. It is also advantageous here that the connection to the valve (typically a cartridge) can be established outside the confines of an outlet tube. This can simplify manufacturing to a considerable extent. It is possible to dispense with a funnel for the (blind) introduction of the hose into the valve. It is also advantageous that the hose, once placed in position, can remain accessible from the outside. The hose can therefore be placed in position in the sanitary fitting in a rigid state or with little twisting or kinking. This can improve the service life of the hose and, in particular, durable sealing capability of the connections.

As an alternative, or in addition, provision can be made here so that, between the interior space and its valve end, the hose extends in the portion outside the housing of the sanitary fitting. The aforementioned portion is therefore located outside the interior space and can be arranged in an easily accessible manner from the outside and, in particular, beneath a supporting structure for the sanitary fitting.

The operation of connecting the hose to the valve can take place for example—in particular in the case of a single-piece hose—once the hose has been placed in position in the interior space or else—in particular in the case of a hose having two or more than two hose pieces—before or during the operation of placing the hose in position in the interior space.

In the case of an advantageous configuration, provision can be made for the interior space to be arranged in an outlet tube of the sanitary fitting. The invention can therefore be advantageously utilized for the particularly restricted space conditions of an outlet tube.

In the case of an advantageous configuration, provision can be made for the hose to have a greater length than can be accommodated by the interior space. It is therefore easily possible to achieve the situation where the hose projects out of the interior space and remains accessible from the outside.

In the case of an advantageous configuration, provision can be made for the hose to be connected to the valve at an underside thereof. It is therefore possible to use, for the connection, an easily accessible location which is concealed during use. Excess hose can therefore remain concealed from an observer.

In the case of an advantageous configuration, provision can be made for a valve-side portion of the hose to be arranged so as to be accessible from outside the sanitary fitting. It is therefore possible for the hose, even once it has been placed in position, to be manipulated and, with visual monitoring, connected to the valve or—directly or indirectly—connected fluidically to the same.

In the case of an advantageous configuration, provision can be made for the hose to have a deflection. This allows the hose to be routed in a space-saving manner, for example, past the valve and back to the same.

Provision can be made here for the hose to be put together from two hose pieces which are connected fluidically to one another via a connecting element. This makes it possible to achieve deflection without any deformation of the hose.

It is particularly advantageous if the connecting element is manufactured from an injection molding or is put together from a plurality of injection moldings. This provides for straightforward manufacturing.

In the case of an advantageous configuration, provision can be made for the connecting element to establish a change in direction of fluid between the hose pieces. This makes it possible to avoid excessively pronounced curvature when the hose is routed outside the interior space to the valve.

For example, the change in direction can be a reversal of direction. This means that the hose pieces can be placed in close proximity to one another.

In the case of an advantageous configuration, provision can be made for the connecting element only to be installed when at least one hose piece has been installed, in particular both hose pieces have been installed by way of their other ends. The hose pieces can therefore easily be made into a standard length—for example by being correspondingly cut to length—before the connecting element is installed.

As an alternative, or in addition, the aforementioned object is achieved, according to the invention, by the features of the alternative independent claim directed to a fluidic arrangement. In particular, it is therefore proposed, according to the invention, in respect of a fluidic arrangement of the type mentioned in the introduction, that the hose should have a deflection at a location which is spaced apart from its two ends. This makes it possible to avoid excessive bending, in particular, when the hose is installed on an underside of the valve. This can reduce the amount of space used up by the hose. Furthermore, this also makes it possible to form a connection between the hose and the valve outside an interior space of a sanitary fitting—for example outside an outlet tube.

In the case of an advantageous configuration, provision can be made for the valve to have a recess in order to accommodate the hose at a location which is spaced apart from the two ends thereof. This easily makes it possible for the hose to be routed past the valve, out of an interior space of a sanitary fitting, in particular of an outlet tube, without this having to create extra bulk in the region of the valve.

In the case of an advantageous configuration, provision can be made for the hose to be connected to the valve at an underside thereof. A simple connection of the hose can therefore be established at a location which is accessible in any case for the connection of further hoses. Moreover, it is therefore possible for the hose to be routed as freely as possible away from the valve.

In the case of an advantageous configuration, provision can be made for the deflection to be established by means of a connecting element, which fluidically connects two hose pieces. This makes it possible to avoid kinking of the hose—for example as a result of an excessive bending load.

In the case of an advantageous configuration, provision can be made for the connecting element to have two hose mounts and a connecting channel, which fluidically connects these mounts. The pieces of the hose can therefore be easily fluidically connected, in particular by insertion into the hose mounts.

Provision can be made here for the hose mounts, on the one hand, and the connecting channel, on the other hand, to be arranged such that they can be separated by a plane. This easily makes it possible to achieve the situation where the two hose pieces terminate on the same side of this plane. This does away with, of avoids, very pronounced curvatures of the hose, which would otherwise be necessary.

It can be said in general terms that, between its exit from the interior space and the valve, the hose forms a downwardly hanging loop. It is advantageous here if the connecting element is arranged at the lowermost location of the loop. This means that the amount of lateral installation space used up is as small as possible.

In the case of an advantageous configuration, provision can be made so that the hose mounts do not diverge in the insertion direction. This can easily achieve a situation where the inserted hose pieces do not obstruct one another.

This can be achieved, for example, in that the hose mounts run parallel or converge. A parallel orientation of the hose mounts has the advantage that the hose pieces can be arranged in particularly close proximity to one another. A converging arrangement has the advantage that injection molding can be particularly straightforward since the respective molds for forming the hose mounts converge and can therefore form the connecting channel with its tips without any additional molds or tools being required.

As an alternative, or in addition, provision can be made so that, in at least one lateral projection, the hose mounts enclose an acute angle. This easily makes it possible to achieve the situation where the hose mounts converge. For example, it is possible, as seen in a different lateral projection, for the hose mounts to be oriented parallel to one another or likewise to enclose an acute angle (possibly a different one). The hose mounts here can coincide or be skewed in relation to one another. It is also possible for the hose mounts to converge and describe an acute solid angle.

A lateral projection can be identified, for example, by a projection direction running perpendicularly in relation to a longitudinal axis of at least one hose mount, or the direction taken by the course of the latter.

In the case of an advantageous configuration, provision can be made for the hose pieces to be retained by material bonding. This makes it possible to achieve a sealed connection of the hose pieces in the connecting element.

As an alternative, or in addition, provision can be made for the hose pieces to be retained in their hose mount by a self-hooking tongue element. This allows for simple installation, without any additional aids being required.

Provision can also be made for one hose piece to be connected to one hose mount by material bonding and for another hose piece to be connected to another hose mount by means of a self-hooking tongue element. This can be determined in dependence on the material of the hose pieces or other use conditions and circumstances.

The hose pieces can be connected for example to their hose mount by being fitted on, inserted or attached. This can be done in the same way or differently for the hose mounts.

In the case of an advantageous configuration, provision can be made for the connecting element to have a first part and a second part. This allows for a complex component to be put together from individual parts which can each be produced individually.

Provision can be made here for the first part to form at least one hose mount. It is advantageous here whether it is possible to dispense with further components for forming the hose mount.

Provision can also be made for the second part to form at least one hose mount. It is advantageous here that it is possible to dispense with further components for forming the hose mount.

It is particularly advantageous if the first part and the second part each form a hose mount. The hose mounts can thus be separated from one another. A fluidic connection in the hose can be established, for example, once the parts have been installed on their respective hose pieces.

As an alternative, or in addition here, provision can be made for a separating surface between the first part and the second part to run outside the hose mounts. It is advantageous here that the situation where the hose mounts are impeded or adversely affected by the separating surface— for example for sealing purposes—can be avoided. The separating surface can be designed, for example, in a planar or curved manner—in particular in the form of a free surface. The separating surface here can define an interface via which the first part can be, or is, connected to the second part.

In the case of an advantageous configuration, provision can be made for the first part to form the two hose mounts and for the second part to form a cover which delimits the connecting channel. The connecting channel can therefore easily be produced by injection molding.

It is particularly advantageous here if the first part forms the hose mounts in one piece. The hose mounts can therefore be oriented in a fixed state in relation to one another. Mechanical stressing between the hose pieces can easily be absorbed.

As an alternative, or in addition, provision can be made here for the second part to form the cover in one piece. The second part can therefore easily be used to complete a liquid pathway. Covers are usually easy to produce by injection molding.

In the case of an advantageous configuration, provision can be made for the first part to have a shaped structure, which engages in the second part to form the connecting channel. This makes it possible to form relatively complex internal geometries.

Provision can be made here for the shaped structure to be arranged at a distance from a sealing flange, which connects the first part and the second part. There is therefore no need for any separate sealing of a complex shaped structure.

As an alternative, or in addition, provision can be made here for the connecting channel to have a constant cross section along its course. It is therefore possible to reduce flow resistance, and turbulence can be reduced or even avoided altogether.

In the case of an advantageous configuration, provision can be made for the first part and the second part together to form a portion of the connecting channel with a cross section which is round. This makes it possible to form an internal geometry which is particularly advantageous for, as far as possible, loss-free flow.

As an alternative, or in addition, provision can be made for the first part and the second part together to form a portion of the connecting channel with a cross section which is constant. A constant cross section of the connecting channel can therefore easily be formed by injection moldings. The resulting longitudinal division avoids holes which would be difficult to realize in the injection mold.

In the case of an advantageous configuration, provision can be made for the first part and the second part to be connected fluidically by way of an axial seal. An axial seal has the advantage that it is possible to establish a connection by way of a plugging or fitting-together movement in a direction transverse to a throughflow direction. Guide means for the plugging or fitting-together movement can therefore be formed so as to absorb axial forces. This relieves the fluidic connection of loading. The risk of a fluidic connection being released by the internal pressure can therefore be reduced, because the opening movement is oriented transversely in relation to the force direction of the loading resulting from the internal pressure.

In the case of an advantageous configuration, provision can be made for the hose mounts of the connecting element to be formed so as to be free of longitudinal burrs. A sealed end fit in the hose mounts is therefore particularly easy to achieve. For example, this can be achieved by a mold-parting line running outside the hose mounts.

In order to achieve the aforementioned object, and as a preferred application of the invention, provision is made in respect of a sanitary fitting, wherein a fluidic arrangement has an outlet piece and a valve and a hose, which fluidically connects the outlet piece to the valve, wherein the outlet piece is fixed to the sanitary fitting, so that, between the outlet piece and its valve end, the hose extends in a portion outside a housing of the sanitary fitting. It is therefore possible for the hose to be returned to the valve outside the sanitary fitting. Obstruction of the routing of the hose in the interior of the housing can therefore be reduced.

It is possible here for the fluidic arrangement to be formed for example according to the invention, in particular as described above and/or as claimed in one of the claims directed to a fluidic arrangement.

As an alternative, or in addition, provision is made in respect of the sanitary fitting so that it is formed on the basis of the use according to the invention, in particular as described above and/or as claimed in one of the claims directed to the use. It is therefore possible to utilize the advantages of the invention in respect of a sanitary fitting, in particular wherein the interior space can be arranged in an outlet tube of the sanitary fitting.

Provision can be made here for the hose to be connected to the valve outside the interior space. The hose can therefore remain accessible for direct or indirect connection to the valve.

Particularly advantageous is the use according to the invention, in particular as described above and/or as claimed in one of the claims directed to the use, in respect of which a fluidic arrangement according to the invention, in particular as described above and/or as claimed in one of the claims directed to a fluidic connection, and/or a fluidic arrangement is utilized as part of the sanitary fitting described above. It is therefore advantageously possible to combine the aforementioned individual aspects.

BRIEF DESCRIPTION OF THE DRAWINGS

The invention will now be described in more detail with reference to exemplary embodiments, although it is not restricted to these exemplary embodiments. Further exemplary embodiments can be gathered from the combination of the features of one or more claims with one another and/or with one or more features of the exemplary embodiments.

In the Figures.

DETAILED DESCRIPTION

Figure 1:
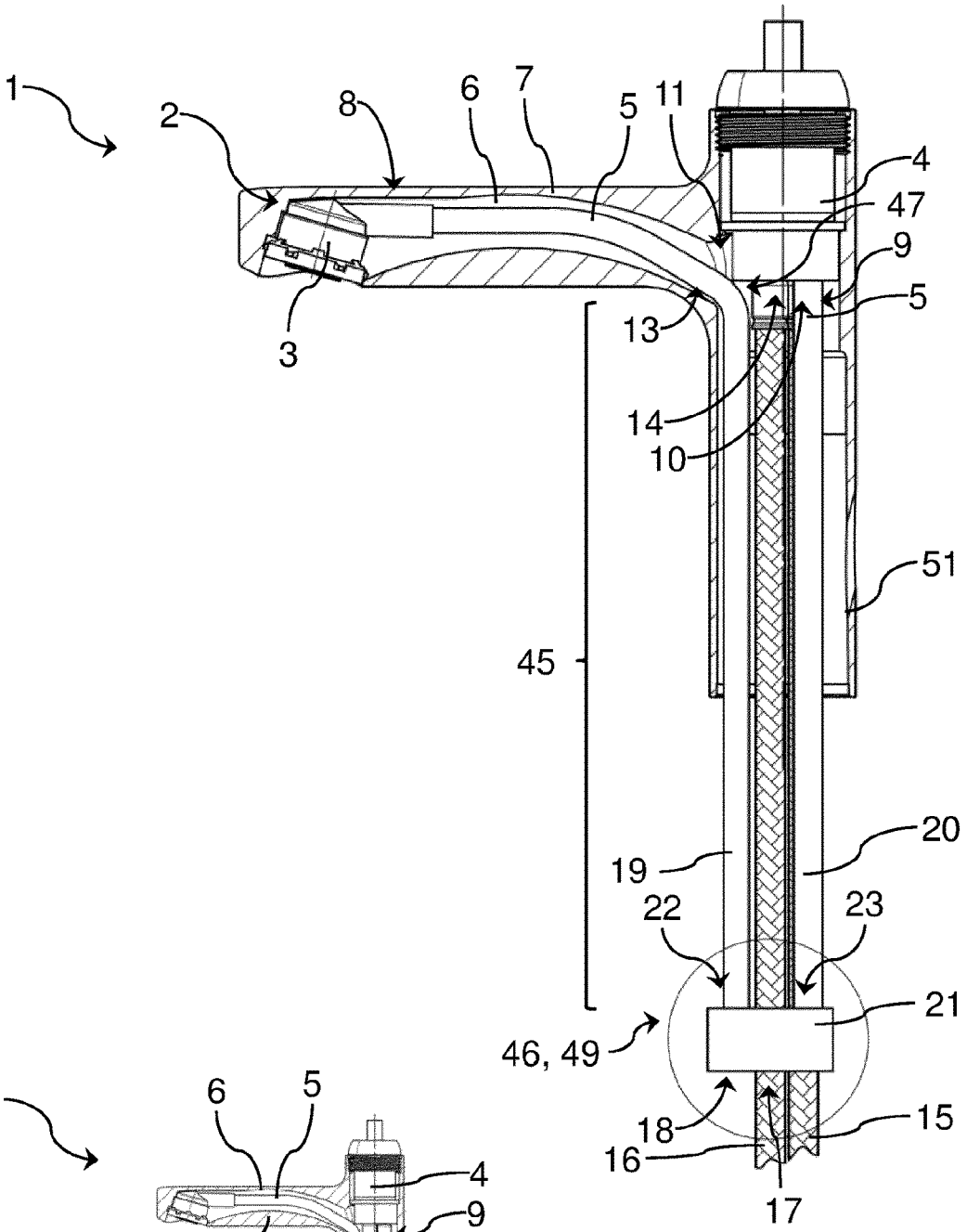
FIG. 1 shows a sanitary fitting having a fluidic arrangement according to the invention, in an axial section.

A sanitary fitting according to FIG. 1, designated as a whole by 1, has a fluidic arrangement 2 for channeling water.

The fluidic arrangement 2 has an outlet piece 3 and a valve 4.

The outlet piece 3 is connected fluidically to the valve 4 via a hose 5.

It is possible, for example, for a jet former and/or a jet regulator, which is known per se, to be arranged or formed in the outlet piece 3.

The hose 5 is arranged here in an interior space 6 of the sanitary fitting 1, the interior space being formed by an outlet tube 7.

The interior space 6 extends here between the outlet piece 3 and the valve 4 and is delimited by the same.

The outlet tube 7 therefore establishes a mechanical connection between the outlet piece 3 and the valve 4.

For the purpose of establishing the fluidic connection, the hose 5 is connected to the outlet piece 3 by way of its outlet end 8.

The hose 5 is routed out of the interior space 6 by way of its valve end 9.

The hose 5 is therefore connected fluidically to the valve 4 at a location 10 which, in the installed use position, is directed away from the outlet piece 3 and the interior space 6.

It can therefore be said that the hose 5 is routed past the valve 4. For this purpose, the valve 4 has a recess 11, which accommodates the hose 5 at a location 13 at least in part between the ends 8, 9.

The hose 5 is connected fluidically to the valve 4 at the underside 14, at which a cold-water hose 15 and a hot-water hose 16 are also connected (in a manner known per se).

A deflection 18 is formed at a location 17 between the ends 8, 9, more precisely—in the exemplary embodiment—between the location 13 and the valve end 9, that is to say outside the interior space 6.

This deflection 18 divides the hose 5 into two hose pieces 19, 20.

The deflection 18 causes the direction of flow between the valve-side hose piece 20 and the outlet-side hose piece 19 to change by more than 90°.

For this purpose, the deflection 18 is established by means of a connecting element 21, which fluidically connects the valve-side hose piece 20 to the outlet-side hose piece 19.

A hose mount 22 for the outlet-side hose piece 19 and a hose mount 23 for the valve-side hose piece 20 are formed on the connecting element 21, for fluidic-connection purposes.

These hose mounts 22, 23 are connected fluidically to one another by a connecting channel 24 (cf., for example, FIGS. 8 to 10), so that water can flow from the valve-side hose piece 20 into the outlet-side hose piece 19.

The hose 5 therefore forms a loop 46 between its exit 47 from the interior space 6 and the valve 4. The deflection 18 is formed at the lowermost location 17 of the loop 46.

Figure 2:
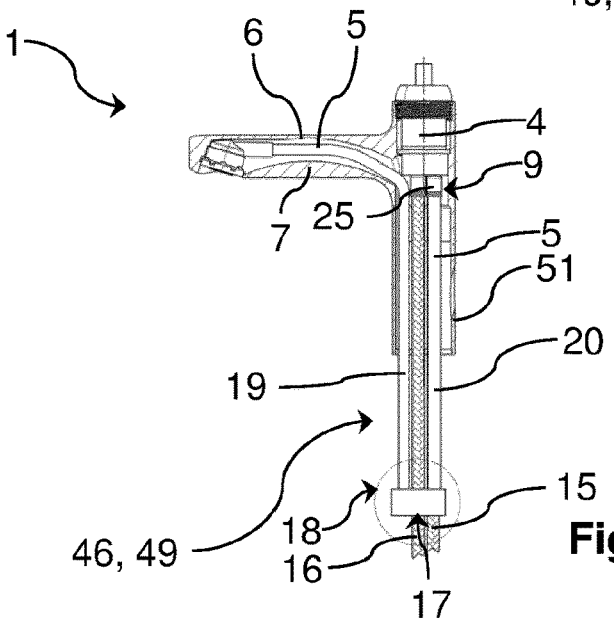
FIG. 2 shows a variant of FIG. 1.
Figure 3:
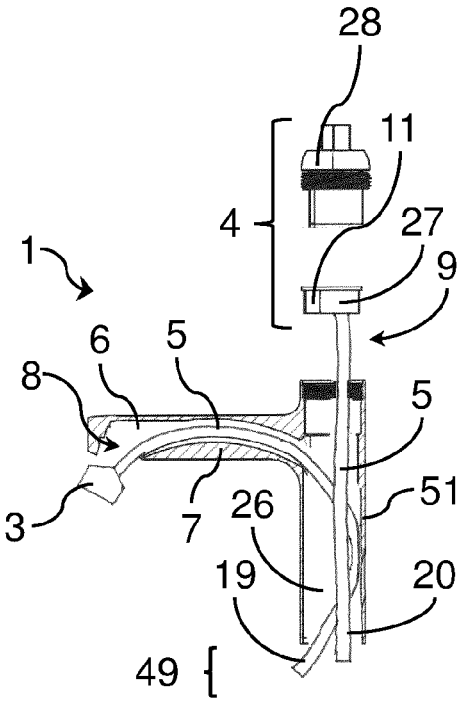
FIG. 3 shows a first installation step in respect of a fluidic arrangement according to the invention.
Figure 4:
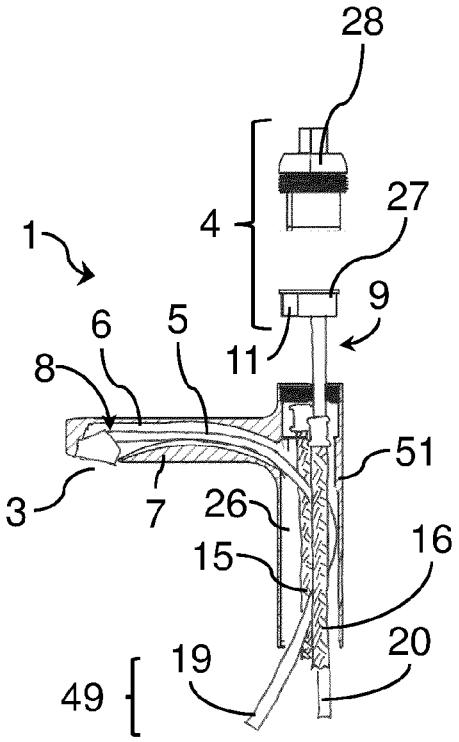
FIG. 4 shows a second installation step in respect of the sanitary fitting according to FIG. 3.
Figure 5:
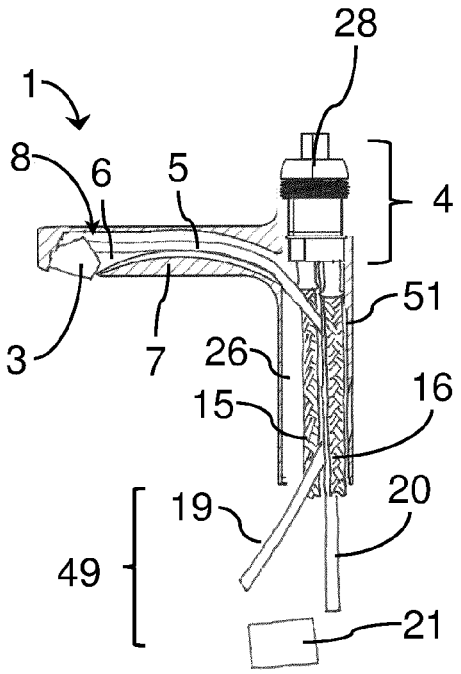
FIG. 5 shows a third installation step in respect of the sanitary fitting from FIG. 3.
Figure 6:
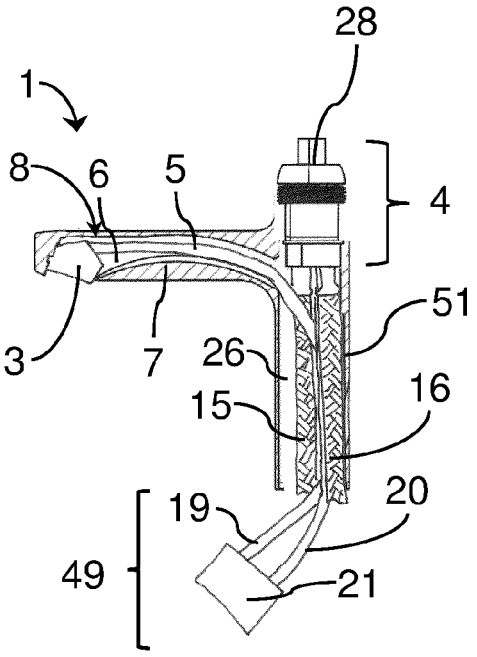
FIG. 6 shows a fourth installation step in respect of the sanitary fitting according to FIG. 3.

FIG. 2 shows a further sanitary fitting 1 having a fluidic arrangement 2 according to the invention. Components and functional units which are similar or identical, in functional and/or design terms, to the preceding exemplary embodiment are denoted by the same reference signs and will not be described separately again. What has been said in relation to FIG. 1 therefore applies correspondingly to FIG. 2.

The exemplary embodiment according to FIG. 2 differs from the preceding exemplary embodiment in that the hose 5 is fastened at its valve end 9, by way of a crimp sleeve 25, on a hose nipple (not illustrated any more specifically but known per se), whereas the hose 5 in FIG. 1 is inserted directly into an appropriate hose mount (not illustrated any more specifically) on the valve 4.

FIGS. 3 to 6 show the installation steps required for installing the fluidic arrangement 2 in respect of the sanitary fitting 1.

Components and functional units which are similar or identical, in design and/or functional terms, to the preceding exemplary embodiments are denoted by the same reference signs and will not be described separately again. What has been said in relation to FIGS. 1 and 2 therefore applies correspondingly to FIGS. 3 to 6.

It can be seen that, in a first step (FIG. 3), first of all the outlet-side hose piece 19, to which it is already possible for the outlet piece 3 to be fastened, is introduced into the vertically oriented space 26 beneath the valve 4 from the outside, via the interior space 6 in the outlet tube 7. It can also be seen that the valve-side hose piece 20, in respect of which it is already possible for an adapter piece 27 to be connected to the valve end 9, is introduced into the space 26 from the outside (top).

In a next step (FIG. 4), the cold-water hose 15 and the hot-water hose 16 are routed as far as the adapter piece 27 from beneath, through the space 26, and are connected to this adapter piece.

After that (FIG. 5), the valve 4 is put together from a main body 28, which accommodates the valve mechanism in a manner known per se, and the adapter piece 27 and is installed on the sanitary fitting 1. It is also possible for this step to take place prior to the second installation step.

The outlet-side hose piece 19 and valve-side hose piece 20 can then be cut to a joint length, by which they project beyond the space 26.

For this purpose, the outlet piece 3 is already shifted into its use position, so that the outlet-side hose piece 19 no longer moves as the procedure continues.

Finally (FIG. 6), the connecting element 21 is positioned on the hose pieces 19, 20 or connected to the same in order to establish a fluidic connection between the valve 4 and the outlet piece 3 and to give rise to a deflection 18 of the water flow at the transfer between the valve-side hose piece 20 and the outlet-side hose piece 19.

Figure 7:
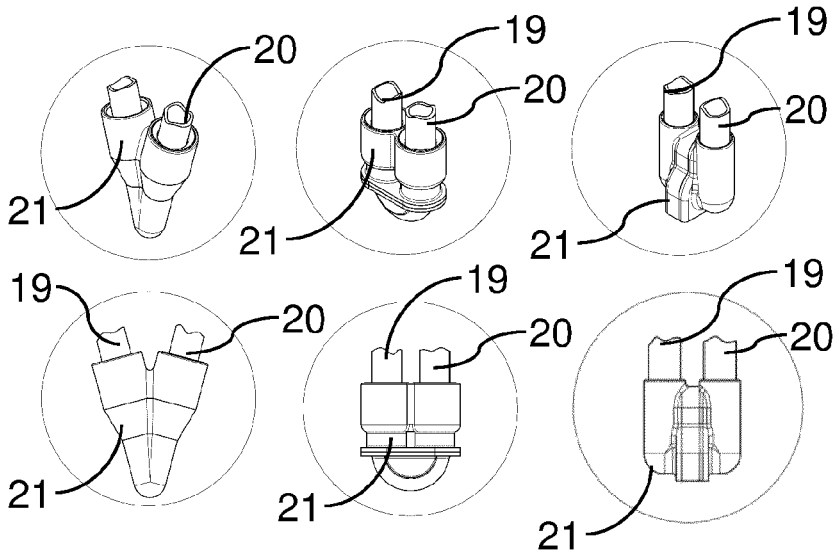
FIG. 7 shows different embodiments of a connecting element of the sanitary fitting according to FIG. 1 and FIG. 2.

FIG. 7 shows, by way of example, three connecting elements 21 which can be utilized instead of the general functional block for example in FIGS. 1 and 2. Each illustration shows a three-dimensional oblique view and a side view. Components and functional units which are similar or identical, in functional and/or design terms, to the preceding exemplary embodiments are denoted by the same reference signs and will not be described separately again.

It can be seen that the hose mounts 22, 23 are arranged relative to one another such that define a solid angle of less than 90°, in particular—in the variants in the center and on the right (parallel hose mounts 22, 23)—a solid angle of 0°.

Figures 8, 9, 10:
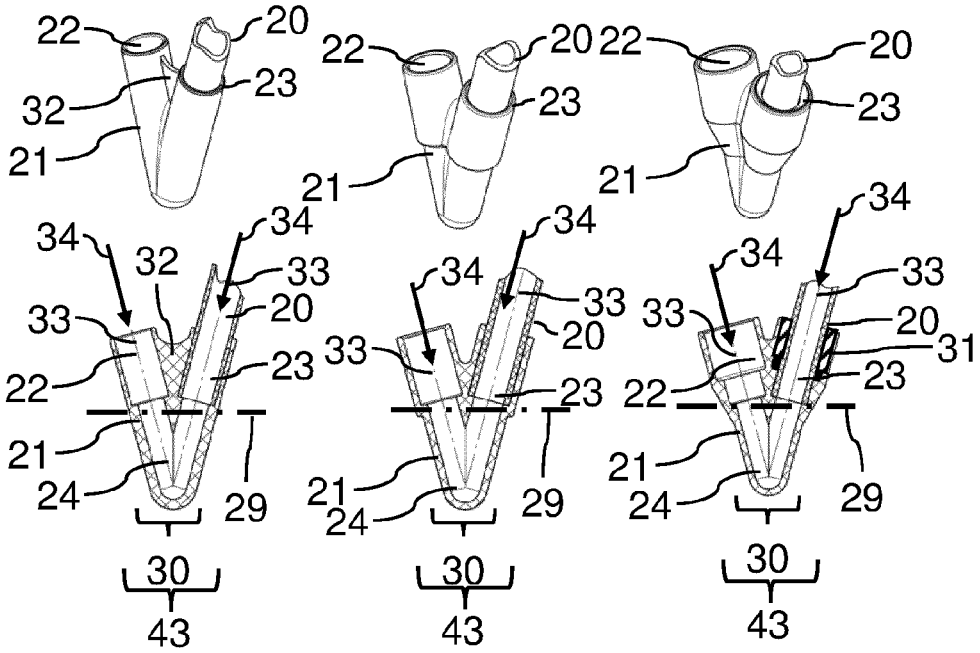
FIG. 8 shows a connecting element from FIG. 7 in a three-dimensional oblique view (top) and in an axial section (bottom)
FIG. 9 shows a variant of FIG. 8.
FIG. 10 shows a further variant of FIG. 8.
Figure 11:
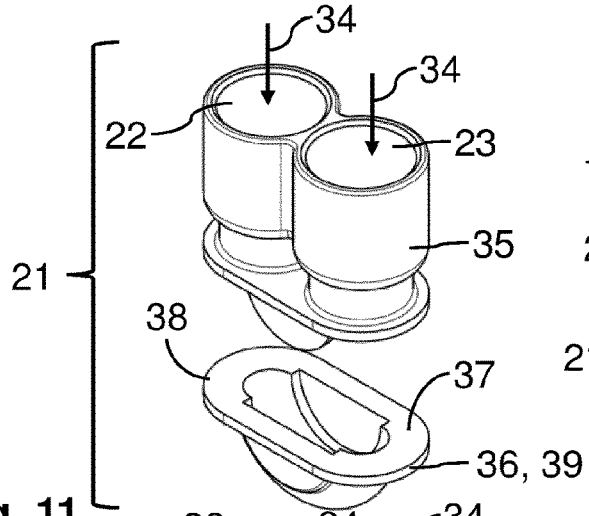
FIG. 11 shows an exploded illustration of a three-dimensional oblique view of a further connecting element from FIG. 7.
Figure 12:
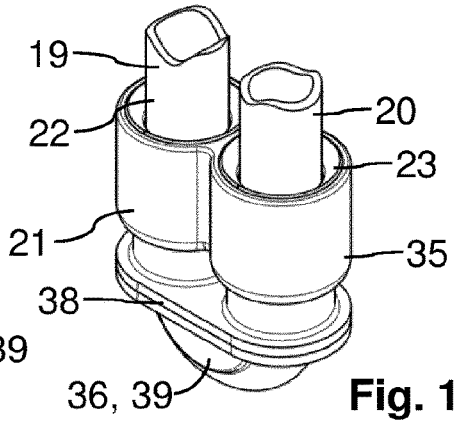
FIG. 12 shows the connecting element from FIG. 11 in the use position.
Figure 13:
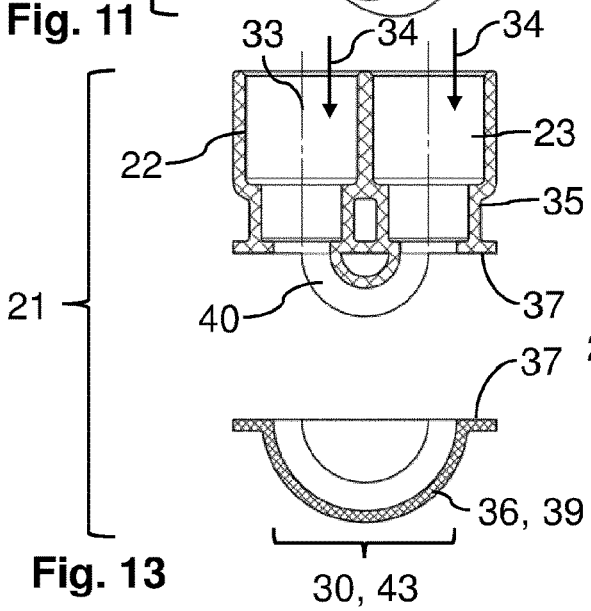
FIG. 13 shows an axial section relating to FIG. 11.

FIG. 8 shows the left-hand connecting element 21 from FIG. 7, in addition, in an axial section.

It can be seen that it is possible to find a plane 29, which is positioned perpendicularly in relation to the drawing plane and separates the hose mounts 22, 23, on the one hand, and the connecting channel 24, on the other hand. It is thus possible to avoid the situation where the inserted hose piece 19, 20, partially or fully closes the connecting channel 24.

In other words, the hose mounts 22, 23 have their openings located in a half-space which does not contain the connecting channel 24, at least the deflecting region 30 thereof.

In the case of the exemplary embodiment according to FIG. 8, the hose piece 19, 20, for example the valve-side hose piece 20, has been inserted into the associated hose mount 23 and secured against being pulled out by way of a self-hooking tongue element 31.

It is possible for the other hose mount 23 to be configured in the same way or—as shown here by way of example—designed so that the outlet-side hose piece 19 can be connected by material bonding or molded thereon.

In the case of further exemplary embodiment, it is possible for both hose mounts 22, 23 to be provided with a self-hooking tongue element 31.

FIG. 9 shows an alternative to the exemplary embodiment according to FIG. 8. FIG. 9 illustrates material-bonding connections in both hose mounts 22, 23.

It is advantageous for both embodiments if the hose mounts are dimensioned such that an inserted hose piece 19, 20, does not leave a step at the transition.

Otherwise, the explanations relating to FIGS. 1 to 8 apply correspondingly.

FIG. 10 shows a further connecting element 21 as an alternative to the connecting element 21 according to FIG. 8.

Once again, both hose mounts 22, 23 are designed for material-bonding connection, for example laser welding, adhesive bonding, etc.

The variant is distinguished by increased stability, which is achieved by thicker walls and a reinforcing gusset 32.

In the case of the exemplary embodiments according to FIGS. 8 to 10, the hose mounts 22, 23 each have a longitudinal axis 33. The longitudinal axes 33 of the two hose mounts 22, 23 coincide at a point and therefore enclose an acute angle. It can therefore be said that the connecting elements 21 of FIGS. 8 to 10 can be enclosed within an acute solid angle.

In the case of further exemplary embodiments, rather than coinciding, these longitudinal axes 33 are skewed in relation to one another. However, these exemplary embodiments give rise to the same image, as seen in lateral projection, as in FIGS. 8 to 10, so that it can be said that it is also the case that the hose mounts 22, 23 of these exemplary embodiments enclose an acute angle in at least one lateral projection, namely the projection onto the drawing plane in the Figures illustrated.

Otherwise, what has been said in relation to FIGS. 1 to 9 applies to these Figures.

The exemplary embodiments according to FIGS. 8 to 10 have in common the fact that the connecting element 21 can be manufactured in a single piece in the form of an injection molding. This is aided by the hose mounts 22, 23 being oriented obliquely in relation to one another, which allows for undercut-free manufacturing in the region of the connecting channel 24.

FIGS. 11 to 14 show a further example of a connecting element 21. This connecting element 21 is illustrated in the center of FIG. 7. Components and functional units which are similar or identical, in functional and/or design terms, to the preceding exemplary embodiments are once again denoted by the same reference signs and will not be described separately again. What has been said in relation to FIGS. 1 to 10 therefore applies correspondingly to FIGS. 11 to 14.

The exemplary embodiment differs from the preceding exemplary embodiments in that the connecting element 21 comprises a first part 35 and a second part 36, which—put together—form a liquid-channel means.

The first part 35 here has two hose mounts 22, 23 formed on it, these being oriented, by way of example, parallel to one another in this case. Obliquely oriented variants similar to FIGS. 8 to 10 are also possible.

The second part 36 is separated from the first part 35 by a separating surface 37, which forms a sealing flange 38. The sealing flange 38 is closed by a material-bonding connection.

This separating surface 37 runs outside the hose mounts 22, 23. The second part 36 forms a cover 39, which delimits the connecting channel 24 in the outward direction.

The first part 35 here has formed on it a shaped structure 40, which projects out of the separating surface 37, engages in the second part 36 and defines one half of a circumference, in cross section, of the connecting channel 24. The other half is defined here by the cover 39.

This makes it possible to achieve the situation where the cross section of the connecting channel 24 remains constant along its course and therefore the cross-sectional surface area does not form any constriction in relation to the hose pieces 19, 20.

Figure 14:
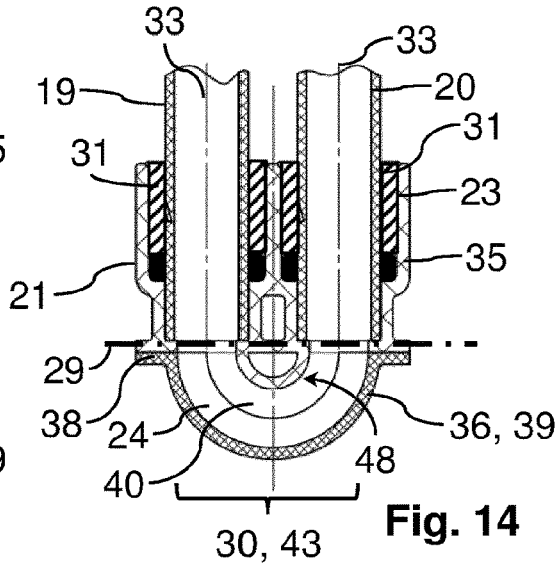
FIG. 14 shows an axial section relating to FIG. 12.
Figure 15:
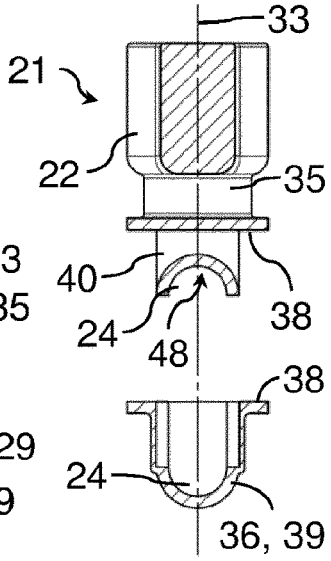
FIG. 15 shows an exploded illustration of a further axial section relating to FIG. 12, wherein the section plane is oriented perpendicularly in relation to the section planes from FIG. 14 and is arranged centrally between the hose mounts.

This is achieved by the shaped structure 40 having a surface 48 which is double-arched or double-curved in the manner of a saddle point (cf. FIGS. 14 and 15). It can also be seen in FIG. 15 that the shaped structure 40, rather than being involved in the sealing of the connecting channel 24, serves merely for flow-channeling purposes. The encircling sealing flange 38 seals the space 26 fully in the outward direction, the shaped structure 40 engaging in the space 26.

Figure 16:
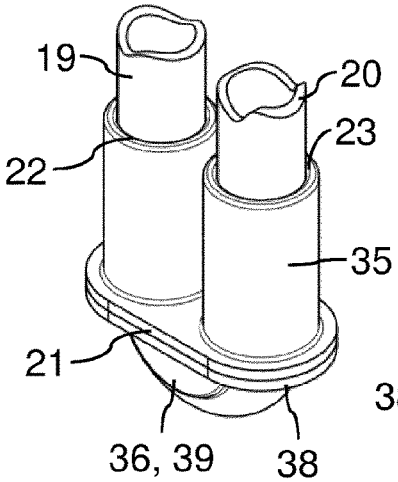
FIG. 16 shows an alternative to the connecting element according to FIG. 12.
Figure 17:
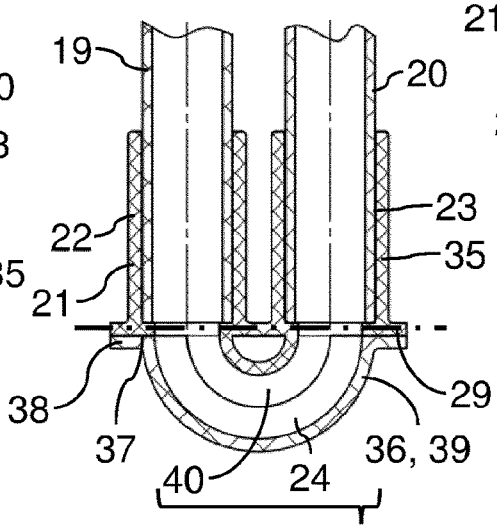
FIG. 17 shows an axial section relating to FIG. 16.

FIGS. 16 and 17 show a variant of the exemplary embodiment according to FIGS. 11 to 15 in which the self-hooking tongue element 31 shown in FIG. 14 is replaced by a material-bonding connection being established between the hose mounts 22, 23 and the hose pieces 19, 20, for example by laser welding or some other kind of welding.

Otherwise, what has been said in relation to the preceding exemplary embodiments applies correspondingly to FIGS. 15 to 17.

Figure 18:
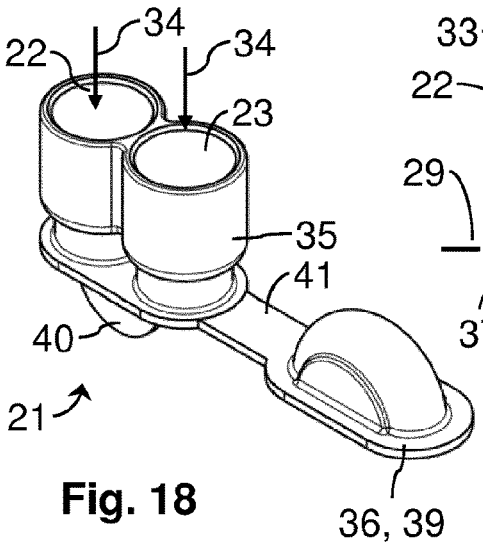
FIG. 18 shows a single-piece variant of FIG. 12.
Figure 19:
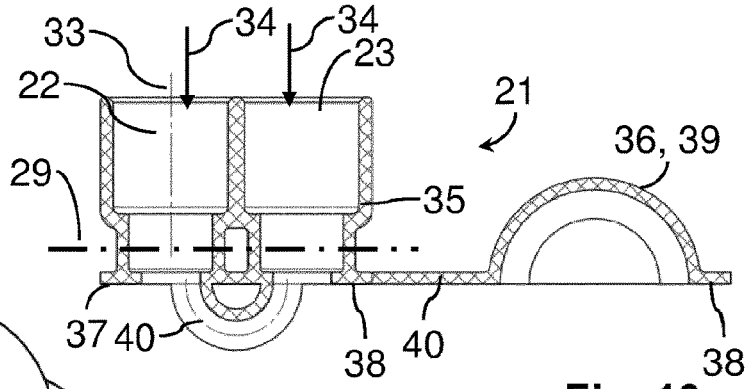
FIG. 19 shows an axial section relating to FIG. 18.

FIGS. 18 and 19 show a further connecting element 21, for example for use in FIG. 1 or 2.

Here, the first part 35 and the second part 36 are connected to one another by a film hinge 41 and can be produced by injection molding. The film hinge 41 allows the parts 35, 36 to be oriented in relation to one another.

Otherwise, what has been said in relation to FIGS. 11 to 17 applies correspondingly.

FIGS. 20 to 23 show a further exemplary embodiment of a connecting element 21. Components and functional units which are similar or identical, in functional and/or design terms, to the preceding exemplary embodiments are denoted by the same reference signs and will not be described separately again. What has been said in relation to FIGS. 1 to 19 therefore applies correspondingly to FIGS. 20 to 23.

The connecting element 21 according to FIGS. 20 to 23 differs from the preceding connecting elements 21 in that, rather than being planar, the separating surface 37 follows a laterally curved course. This prevents the separating surface 37, which is arranged in an axial plane, from running into the hose mounts 22, 23.

It is therefore the case that the hose mounts 22, 23—like the other hose mounts as well—are formed so as to be free of longitudinal burrs and therefore allow a particularly snug end fit against the inserted hose pieces 19, 20.

The second part 36 here is oriented on the first part 35 by way of a positioning aid 50. After that, the two parts 35, 36 are connected by material bonding.

Figure 20:
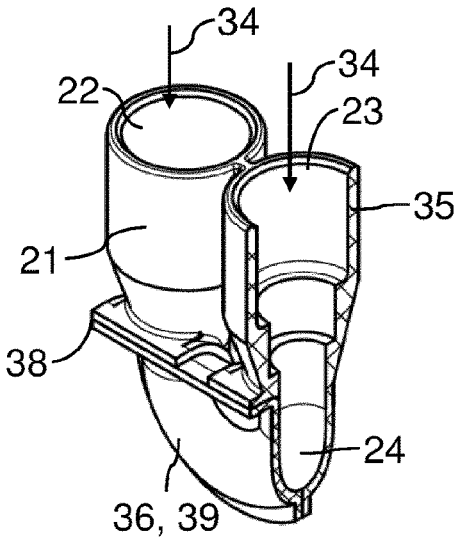
FIG. 20 shows a variant of FIG. 12 with a cover, which has a curved sealing flange.
Figure 21:
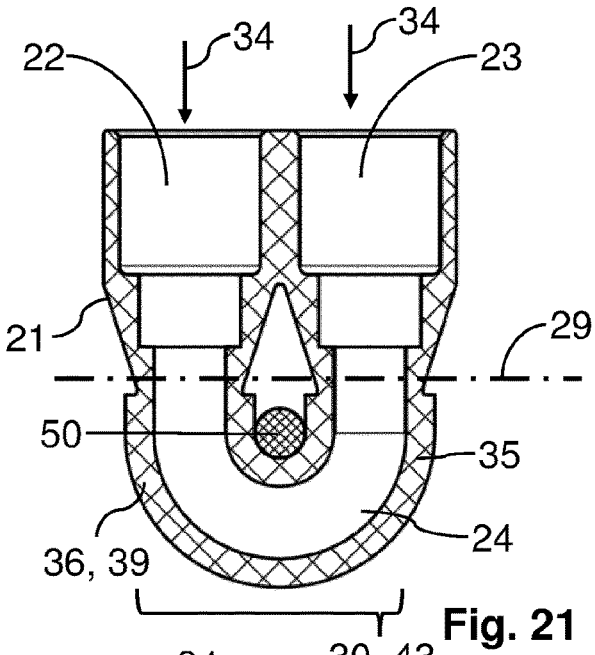
FIG. 21 shows an axial section relating to FIG. 20.
Figure 22:
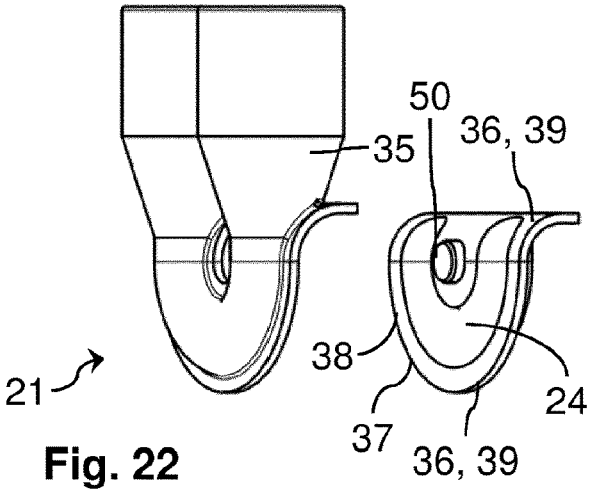
FIG. 22 shows an exploded illustration in a three-dimensional oblique view relating to FIG. 20.
Figure 23:
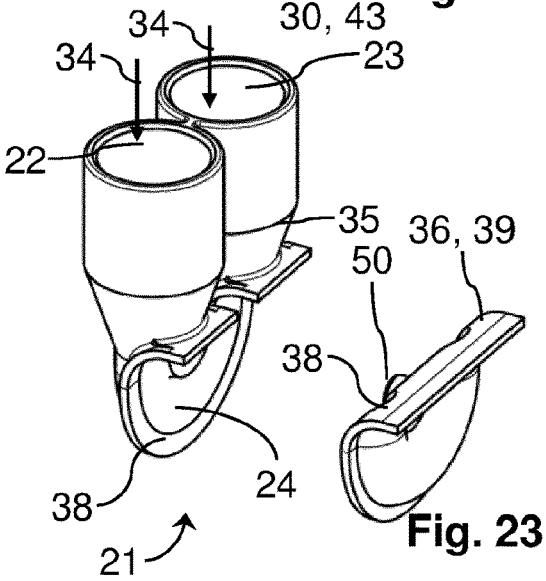
FIG. 23 shows a further illustration analogous to FIG. 22, but from a different viewing angle.

The two parts 35, 36 each define half a circumference, in cross section, of the connecting channel 24, as can be seen from FIG. 20.

Figure 24:
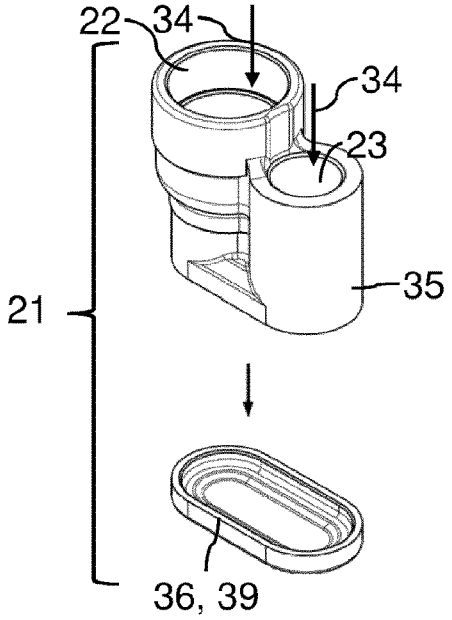
FIG. 24 shows a further alternative to FIG. 12.
Figure 25:
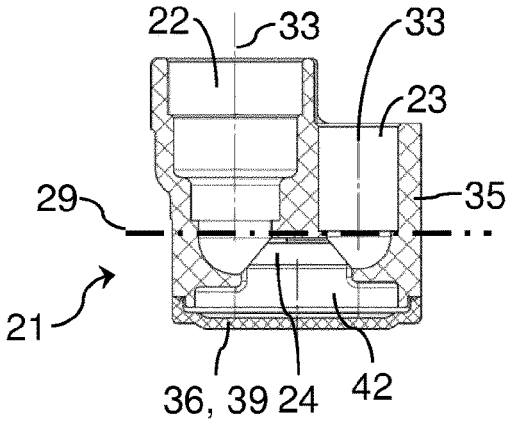
FIG. 25 shows an axial section relating to FIG. 24.
Figure 26:
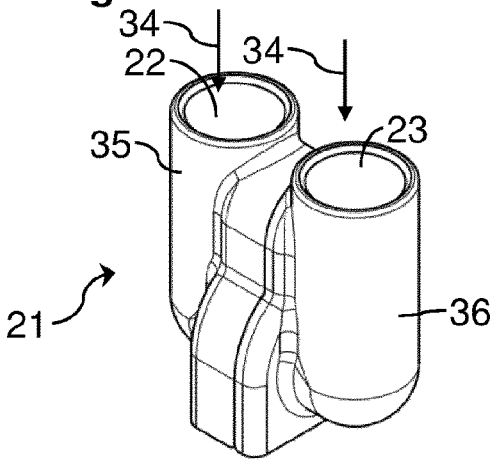
FIG. 26 shows a three-dimensional oblique view of a further connecting element from FIG. 7.
Figure 27:
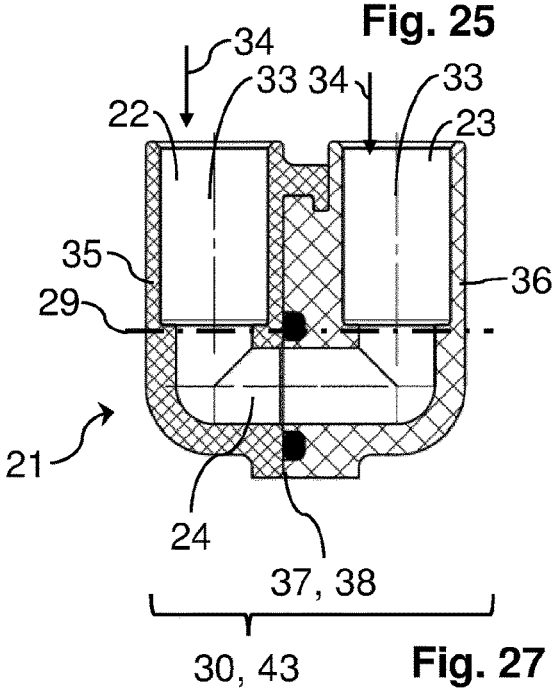
FIG. 27 shows an axial section relating to FIG. 26.
Figure 28:
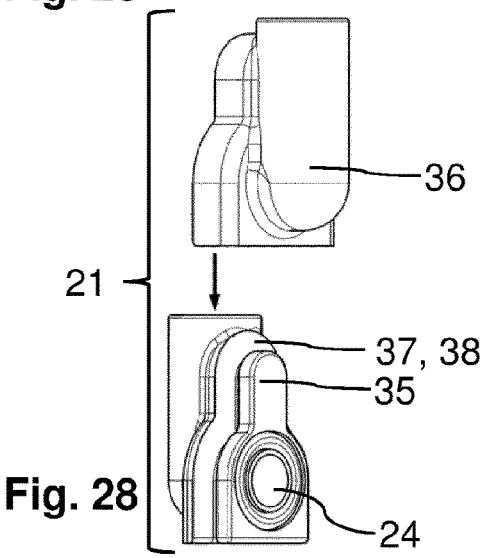
FIG. 28 shows the assembly operation to give the embodiment according to FIG. 26.
Figure 29:
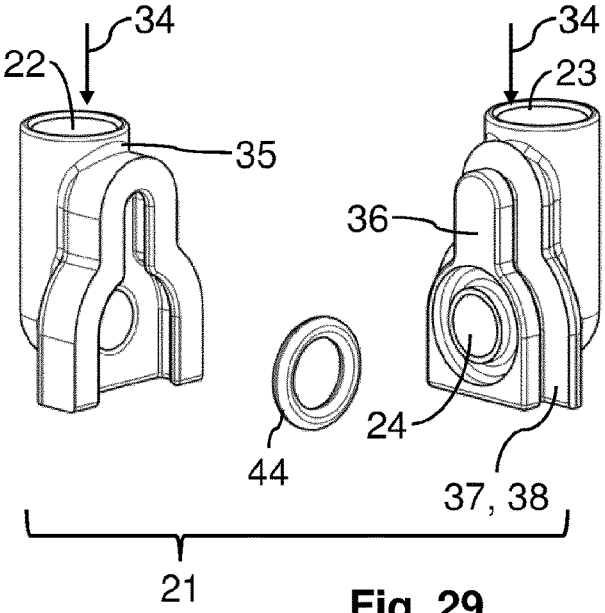
FIG. 29 shows the disassembled connecting element according to FIG. 26, in a view of the open interface.

FIGS. 24 and 25 show a further connecting element 21. In the case of this connecting element, the cover-form second part 36 is of essentially flat or planar design, so that the connecting channel 24 has a dead space 42 provided by a widening in cross section.

FIGS. 26 to 29 show detail-specific views of the connecting element 21 from the right-hand image of FIG. 7.

An axial seal 44 is formed on the separating surface 37, which in this case runs between the hose mounts 22, 23.

The first part 35 and the second part 36 can be displaced in relation to one another in the sealing plane in order to be retained in a form-fitting manner.

This variant likewise provides for the manufacture of two individual parts which can be demolded and therefore produced by injection molding.

Overall, it can be said that the shaped structure 40 is configured and arranged such that the connecting channel 24 has a constant cross section at least in the portion 43.

It is therefore proposed according to the invention, in respect of a fluidic arrangement 2 which can be installed in the interior of a sanitary fitting 1, that a hose 5, which connects an outlet piece 3 to a valve 4, should be designed to be long enough for the hose 5 to project out of an interior space 6, which connects the valve 4 in spatial terms to the outlet piece 3. This projecting portion of the hose 5 is connected fluidically to the valve 4 outside the interior space 6.

LIST OF REFERENCE SIGNS

1 Sanitary fitting
2 Fluidic arrangement
3 Outlet piece
4 Valve
5 Hose
6 Interior space
7 Outlet tube
8 (outlet) end
9 (valve) end
10 Location
11 Recess
13 Location
14 Underside
15 Cold-water hose
16 Hot-water hose
17 Location
18 Deflection
19 (outlet-side) hose piece
20 (valve-side) hose piece
21 Connecting element
22 Hose mount
23 Hose mount
24 Connecting channel
25 Crimp sleeve
26 Space
27 Adapter piece
28 Main body of 4
29 Plane
30 Deflecting region of 21
31 Tongue element
32 Reinforcing gusset
33 Longitudinal axis of 22, 23
34 Insertion direction
35 First part
36 Second part
37 Separating surface
38 Sealing flange
39 Cover
40 Shaped structure
41 Film hinge
42 Dead space
43 Portion of 24
44 Axial seal
45 Valve-side portion of 5
46 Loop
47 Exit
48 Surface
49 Portion
50 Positioning aid
51 Housing

The invention claimed is:

1. A method for fluidically connecting an outlet piece (3) to a valve (4) on a sanitary fitting (1), the method comprising:

between the outlet piece (3) and the valve (4), arranging a hose (5) with a portion (49) that extends outside a housing (51) of the sanitary fitting (1); and fixing the outlet piece (3) to the sanitary fitting (1), wherein the hose (5) has a deflection (18) established by a connecting element (21), wherein the connecting element (21) has a first part (35) and a second part (36), and wherein the first part (35) has a shaped structure (40) which engages in the second part (36) to form a connecting channel (24).

2. The method as claimed in claim 1, further comprising arranging at least part of the hose (5) in an interior space (6) of the sanitary fitting (1), the interior space extending between the outlet piece (3) and the valve (4), and routing the hose (5) out of the interior space (6) by connecting a valve end (9) thereof to the valve (4) outside the interior space (6).

3. The method as claimed in claim 2, wherein the interior space (6) is arranged in an outlet tube (7) of the sanitary fitting (1).

4. The method as claimed in claim 2 the hose (5) has a greater length than can be accommodated by the interior space (6).

5. The method as claimed in claim 1, further comprising connecting the hose (5) to the valve (4) at an underside (14) thereof.

6. The method as claimed in claim 1, further comprising arranging a valve-side portion (45) of the hose (5) to be accessible from outside the sanitary fitting (1).

7. The method as claimed in claim 1, wherein the hose (5) is put together from two hose pieces (19, 20) which are connected fluidically to one another via a connecting element (21).

8. The method as claimed in claim 7, wherein the connecting element (21) establishes a change in direction of fluid between the two hose pieces (19, 20).

9. The method as claimed in claim 7, further comprising only installing the connecting element (21) when at least one of the two hose pieces (19, 20) has been installed in the sanitary fitting (1).

10. A fluidic arrangement (2) for a sanitary fitting (1), the fluidic arrangement (2) comprising:

an outlet piece (3);

a valve (4);

a hose (5), which fluidically connects the outlet piece (3) to the valve (4), the hose (5) being connected fluidically at a location (10, 17) of the valve (4) that, in a use position of the valve (4), is directed away from the outlet piece (3); and the hose (5) has a deflection (18) at a location (10, 17) which is spaced apart from two ends (8, 9) thereof, wherein the deflection (18) is established by a connecting element (21), wherein the connecting element (21) has a first part (35) and a second part (36), wherein the first part (35) has a shaped structure (40) which engages in the second part (36) to form a connecting channel (24).

11. The fluidic arrangement (2) as claimed in claim 10, wherein the valve (4) has a recess (11) to accommodate the hose (5) at a location (10, 17) which is spaced apart from the two ends (8, 9) thereof.

12. The fluidic arrangement (2) as claimed in claim 10, wherein the hose (5) is connected to the valve (4) at an underside (14) thereof.

13. The fluidic arrangement (2) as claimed in claim 10, wherein the connecting element (21) fluidically connects two hose pieces (19, 20) that form the hose.

14. The fluidic arrangement (2) as claimed in claim 13, wherein the connecting element (21) has two hose mounts (22, 23) and a connecting channel (24), which fluidically connects the two hose mounts.

15. The fluidic arrangement (2) as claimed in claim 14, wherein the hose mounts (22, 23) do not diverge in an insertion direction (34).

16. The fluidic arrangement (2) as claimed in claim 14, wherein the hose pieces (19, 20) are retained in respective ones of the hose mounts (22, 23) by at least one of material bonding or a self-hooking tongue element (31).

17. The fluidic arrangement (2) as claimed in claim 13, wherein at least one of the first part (35) or the second part (36) forms at least one hose mount (22, 23), and a separating surface (37) between the first part and the second part runs outside of the at least one hose mount (22, 23).

18. The fluidic arrangement (2) as claimed in claim 17, wherein the first part (35) forms two of the hose mounts (22, 23), and the second part (36) forms a cover (39) which delimits a connecting channel (24).

19. The fluidic arrangement (2) as claimed in claim 17, wherein the first part (35) and the second part (36) together form a portion (43) of a connecting channel (24) with a cross section which is at least one of round or constant along a course thereof.

20. The fluidic arrangement (2) as claimed in claim 17, wherein the first part (35) and the second part (36) are connected fluidically by way of an axial seal (44).

21. The fluidic arrangement (2) as claimed in claim 17, wherein the hose mounts (22, 23) of the connecting element (21) are formed free of longitudinal burrs.

22. The fluidic arrangement (2) as claimed in claim 13, wherein, between an exit (47) from an interior space (6) of the sanitary fitting (1) and the valve (4), the hose (5) forms a downwardly hanging loop (46), and the connecting element (21) is arranged at a lowermost location (17) of the loop (46).

23. A sanitary fitting (1), comprising: a fluidic arrangement (2) with an outlet piece (3) and a valve (4) and a hose (5), which fluidically connects the outlet piece (3) to the valve (4), the outlet piece (3) is fixed to the sanitary fitting (1), and, between the outlet piece (3) and a valve end (9) of the hose, the hose (5) extends in a portion (49) outside a housing (51) of the sanitary fitting (1)

wherein the hose (5) has a deflection (18) established by a connecting element (21), wherein the connecting element (21) has a first part (35) and a second part (36), and wherein the first part (35) has a shaped structure (40) which engages in the second part (36) to form a connecting channel (24).

24. The sanitary fitting (1) as claimed in claim 23, wherein at least part of the hose (5) is arranged in an interior space (6) of the sanitary fitting (1), the interior space extends between the outlet piece (3) and the valve (4), and at least one of between the interior space (6) and the valve end (9) of the hose, the portion (49) of the hose extends outside the housing (51), or the hose (5) is connected to the valve (4) outside the interior space (6).

* * * * *